United States Patent [19]

Iida

[11] Patent Number: 4,824,825

[45] Date of Patent: Apr. 25, 1989

[54] COLOR DEVELOPER SHEET FOR PRESSURE-SENSITIVE RECORDING

[75] Inventor: Toshizo Iida, Himeji, Japan

[73] Assignee: Mitsubishi Paper Mills, Ltd., Tokyo, Japan

[21] Appl. No.: 121,886

[22] Filed: Nov. 17, 1987

[30] Foreign Application Priority Data

| | | | |
|---|---|---|---|
| Nov. 18, 1986 | [JP] | Japan | 61-276195 |
| Jul. 7, 1987 | [JP] | Japan | 62-170792 |
| Oct. 26, 1987 | [JP] | Japan | 62-271187 |

[51] Int. Cl.[4] ..... B41M 5/16; B41M 5/22

[52] U.S. Cl. ..... 503/214; 427/150; 428/914; 503/219; 503/225

[58] Field of Search ..... 503/214, 219, 225, 216; 427/150–152; 428/914

[56] References Cited

U.S. PATENT DOCUMENTS

| | | | |
|---|---|---|---|
| 3,859,112 | 1/1985 | Kohmura et al. | 503/209 |
| 4,642,662 | 2/1987 | Torii et al. | 503/215 |
| 4,665,410 | 5/1987 | Iiyama et al. | 503/204 |

FOREIGN PATENT DOCUMENTS

| | | | |
|---|---|---|---|
| 50-17888 | 6/1975 | Japan . | |
| 52-20114 | 2/1977 | Japan . | |
| 52-54515 | 5/1977 | Japan . | |
| 56-27391 | 3/1981 | Japan . | |
| 137189 | 8/1982 | Japan | 503/214 |
| 57-178788 | 11/1982 | Japan . | |

*Primary Examiner*—Ellis P. Robinson
*Assistant Examiner*—P. R. Schwartz
*Attorney, Agent, or Firm*—Cushman, Darby & Cushman

[57] ABSTRACT

A color developer sheet for pressure-sensitive recording containing as a color developer only novolak phenol resin or novolak phenol resin and a semi-synthetic solid acid, and as a binder an acrylamide-acrylic acid copolymer can prevent yellowing of the color developer sheet and give higher developed color density.

7 Claims, No Drawings

COLOR DEVELOPER SHEET FOR PRESSURE-SENSITIVE RECORDING

BACKGROUND OF THE INVENTION

This invention relates to a color developer sheet for pressure-sensitive recording preventing yellowing of the color developer sheet.

Pressure-sensitive recording paper is wellknown and disclosed, for example, in U.S. Pat. Nos. 2,712,507; 2,800,457 and 3,418,250, wherein an electron donative, absorbable, color formable, and colorless organic compound (hereinafter referred to as "a color former") dissolved in a high boiling point solvent and stored in microcapsules is combined with an electron-accepting, reactive and adsorbing substance (hereinafter referred to as "a color developer") and a color is produced by a color forming reaction when the two are contacted.

As the electron-accepting color developer, there have been proposed clay series color developers such as natural clay minerals e.g. acid clay, attapulgite, etc., and active clay obtained by treating acid clay which is a montmorillonite clay mineral with a mineral acid slightly or considerably; organic color developers such as various phenol compounds, novolak type phenol resins, polyvalent metal salts of aromatic carboxylic acids, etc.

For example, the novolak type phenol resins have various advantages in that developed color images with high density can be obtained by the use of a small amount thereof, the developed color images are remarkably resistant to moisture, water, the lapse of time, light, heat, an oxidative gas such as $NO_x$, etc. and not discolored, the novolak type phenol resins are cheap and advantageous industrial organic materials, and pressure-sensitive recording paper obtained by using the novolak type phenol resins has a remarkably long product life (shelf life) and does not lose color forming ability for a long period of time. But the novolak type phenol resins also have a disadvantage in that the whiteness of the color developer layer is often lowered with the lapse of time depending on a storing atmosphere. The yellowing of the color developer layer lowers the commercial value remarkably, although the color developing ability which is a fundamental role of the color developer layer is not lost during the storage. The yellowing of the color developer layer seems to be caused by photo oxidation by sun light and illumination lights, and/or pure chemical reasons. Sometimes, the yellowing of the color developer layer takes place when allowed to stand in a room using an oil heater, a coal stove or a gas heater for heating purposes in winter, or when placed in an area exposed to an exhaust gas from cars. This means that oxidative gases such as nitrogen oxides (represented by $NO_x$), sulfur oxides (represented by $SO_x$) in the air seem to be a cause for the yellowing. This can be proved when a novolak type phenol resin-containing color developer sheet is placed in a chamber filled with high concentration $NO_x$ for a certain period of time, resulting in causing yellowing of a white ground.

On the other hand, the use of a clay series color developer and a phenol resin color developer is proposed, for example, in Japanese Patent Examined Publication No. 50-17888, Japanese Patent Unexamined Publication Nos. 52-20114, 52-54515, 56-27391, 57-178788, etc. But the degree of yellowing of the color developer sheet is remarkably worse than the case of using the novolak series color developer alone presumably due to oxidation, adsorption or catalytic action of the clay series color developer itself. This becomes a large obstacle for commercializing such a color developer sheet.

Further, the yellowing of color developer sheet seems to be also influenced by a binder used in the color developer layer.

As the binder, there have been used water-soluble naturally produced polymeric compounds such as proteins, cellulose, sucrose, etc.; water-soluble synthetic polymers or latexes such as polyvinyl alcohol, polyvinyl pyrrolidone, polyacrylamide, styrene-maleic anhydride copolymer, polyacrylate, styrene-butadiene copolymer latex, etc. The color developer sheets using latexes or water-soluble naturally produced polymeric compounds are good at color forming ability but have a defect of easily growing yellowish. On the other hand, the synthetic polymers such as polyvinyl alcohol, polyvinyl pyrrolidone, etc. can make the resistance to yellowing good, but give poor color forming ability. Particularly when a novolak type phenol resin is used as a color developer in the color developer sheet for pressure-sensitive recording, the prevention of yellowing of the color developer sheet is a serious problem. A binder suitable for such a purpose is not proposed.

SUMMARY OF THE INVENTION

It is an object of this invention to provide a color developer sheet which is prevented from yellowing due to oxidative gases such as $NO_x$ and gives developed color images with high density.

This invention provides a color developer sheet for pressure-sensitive recording comprising a support and formed thereon a color developer layer comprising as a color developer a novolak phenol resin, and as a binder a copolymer of acrylamide and acrylic acid in a monomer weight ratio of 90:10 to 99.5:0.5 in terms of the ratio of acrylamide to acrylic acid.

This invention also provides a color developer sheet for pressure-sensitive recording comprising a support and formed thereon a color developer layer comprising as a color developer a novolak phenol resin and a semi-synthetic solid acid, and as a binder a copolymer of acrylamide and acrylic acid in a monomer weight ratio of 90:10 to 99.5 to 0.5 in terms of the ratio of acrylamide to acrylic acid, said semi-synthetic solid acid obtained by acid treating a clay mineral having a layer structure of silica regular tetrahedron so as to make the $SiO_2$ content 82 to 96.5% by weight on dry basis (dried at 105° C. for 3 hours), contacting the acid-treated clay mineral with a partially soluble magnesium and/or aluminum-containing compound in an aqueous medium, or further neutralizing with an alkali or an acid to form a hydroxide when the partially soluble Mg and/or Al-containing compound is other than a hydroxide, so as to introduce magnesium and/or aluminum components into the acid-treated clay mineral, and if necessary followed by drying.

DESCRIPTION OF THE PREFERRED EMBODIMENTS

The color developer used in this invention is a novolak phenol resin or a novolak phenol resin and a special semi-synthetic solid acid.

As the novolak phenol resin, there can be used novolak paraphenylphenol resin, novolak para-t-butylphenol resin, novolak para-octylphenol resin, novolak para-chlorophenol resin, novolak para-cumylphenol resin, etc. alone or as a mixture thereof. From the viewpoint of color developing ability, the use of novolak para-phenylphenol resin is preferable.

On the other hand, when the novolak phenol resin is used together with a clay series color developer such as natural clay minerals or active clay obtained by acid treating the natural clay slightly or considerably, the object of this invention cannot be attained. The clay series color developer is the oldest color developer but insufficient in color developing ability. Thus, it is replaced by organic color developers or used together with a novolak phenol resin, but further improvement has been still desired.

In this invention, the special clay color developer, that is, the semi-synthetic solid acid is used. The semi-synthetic solid acid is obtained by acid treating a clay mineral having a layer structure of silica regular tetrahedron so as to make the $SiO_2$ content 82 to 96.5% by weight on dry basis (dried at 105° C. for 3 hours), contacting the acid-treated clay mineral with a partially soluble magnesium and/or aluminum-containing compound in an aqueous medium, or further neutralizing with an alkali or an acid to form a hydroxide when the partially soluble magnesium and/or aluminum-containing compound is other than a hydroxide, so as to introduce magnesium and/or aluminum components into the acid treated clay mineral, and if necessary followed by drying. The semi-synthetic solid acid can improve the color developing ability for an electron donative leuco dye and is clearly different from the known clay series color developers. Such a semi-synthetic solid acid can be produced by a process disclosed in Japanese Patent Unexamined Patent No. 57-15996, wherein said semi-synthetic solid acid is used as a color former.

In this two-component color developer system, the novolak phenol resin and the semi-synthetic solid acid are preferably used in a weight ratio of 1:0.5 to 1:10, more preferably 1:1 to 1:4. When the using amount of the semi-synthetic solid acid increases too much, the viscosity of the resulting coating liquid increases undesirably to make practical use impossible.

The color developer layer used in this invention may contain one or more ordinary inorganic pigments such as clay, kaolin, titanium white, calcium carbonate, titanium dioxide, zinc white, magnesium oxide, talc, alumina, etc., and organic pigments such as plastic pigments alone or as a mixture thereof in addition to the semi-synthetic solid acid. It is also possible to use known active clay which is obtained by slightly or considerably treating natural clay minerals with an acid. But since the ability of active clay as a color developer is inferior to the semi-synthetic solid acid, the novolak phenol resin should be used in a larger amount in order to compensate the inferior color developing ability of the acid clay, which results in increasing the yellowing. Thus, the co-use of the active clay does not give any positive advantage.

Another feature of this invention is to use a special binder in the color developer layer.

The present inventors have found that the binder not only is effective for adhering the color developer layer to a base sheet or support, but also influences performance of pressure-sensitive recording sheets such as color forming ability, resistance to yellowing, stability of developed color images, etc.

It is found that the novolak phenol resin causes remarkable yellowing of the color developer sheet for pressure-sensitive recording. Thus, the use of a smaller amount of the novolak phenol resin is preferable to reduce the yellowing of the color developer sheet. But this is not a complete solution. In this invention, the use of a special binder in combination with the novolak phenol resin or the novolak phenol resin and the semi-synthetic solid acid is necessary to attain the object of this invention.

As the binder, there is used a copolymer of acrylamide and acrylic acid in a monomer weight ratio of 90:10 to 99.5:0.5 in terms of the ratio of acrylamide to acrylic acid.

When the weight ratio of the acrylic acid is less than 0.5, the synthetic reaction becomes unstable and impossible to yield the copolymer having constant properties. On the other hand, when the weight ratio of acrylic acid is more than 10, the color forming ability which is the most important property for the color developer sheet for pressure-sensitive recording is undesirably lowered.

Ordinary polyacrylamides available commercially are copolymers of three or four components such as butyl acrylate and acrylonitrile in addition to acrylamide and acrlyic acid. Such polyacrylamides are not effective in this invention.

The amount of the binder in a coating liquid is preferably 5 to 20% by weight, more preferably, 10 to 16% by weight (on solid basis).

If necessary, ordinary binders can be used in addition to the special polyacrylamide used in this invention so long as they do not damage the effects of this invention.

The color developer layer may further contain one or more anti-foam agents, lubricants, dispersing agents, soaking agents, water resistance imparting agents, etc., depending on purposes.

The color former which forms a color by the reaction with the color developer is usually dissolved in a high boiling-point solvent and stored in microcapsules and coated on a separate support in the case of a separate type pressure-sensitive recording system, or coated on the same support in the case of a self-contained type pressure-sensitive recording system.

Microcapsules can be produced by conventional processes such as a coacervation process, an in situ process, an interface polymerization process, etc.

As the color former, there can be used conventionally used ones, for example, tri-arylmethane phthalides such as Crystal Violet lactone, 3,3-bis(p-dimethylaminophenyl)naphthalide, 3-(p-dimethylaminophenol)- 3-(2-methylindole-3-yl)-6-dimethylaminophthalide, etc.; acyl derivatives such as benzoyl, anisoyl or pivaloyl derivatives of methylene blue; xanthenephthalides such as 3-diethylamino-6-methyl-7-chlorofluoran, 3-diethylamino-7-dibenzylaminofluoran, etc.

As the high boiling-point solvent, there can be used conventionally used ones, for example, alkyl naphthalenes such as diisopropyl naphthalene, etc.; diarylalkanes such as 1-phenyl-1-xylylethane, etc.; alkyl biphenyls such as isopropyl biphenyl, etc.; aromatic hydrocarbons such as triaryldimethanes, alkyl benzenes, benzyl naphthalenes, diarylalkylenes, arylindanes, etc.; carboxilic acid esters such as dibutyl phthalate, dioctyl maleate, etc.; phosphoric acid esters such as tricresyl phosphate, etc.; natural animal and vegetable fats and oils such as castor oil, soybean oil, cottonseed oil, etc.; high-boiling point fractions (consisting of aliphatic hydrocarbons) of natural products such as mineral oils, etc.

As the support, there can be used paper, non-woven fabrics, plastic films, synthetic paper, metal foils, etc., or a composite sheet obtained by using these materials.

The color developer sheet for pressure-sensitive recording of this invention can be obtained by a conventional process, for example, by coating a coating liquid containing a color developer and a binder on a support and drying the coating liquid to form a color developer layer on the support.

The color developer sheet for pressure-sensitive recording of this invention can prevent yellowing of the color developer sheet by heat, light, oxides, etc., and improve the developed color density of obtained images. This seems to be caused by the use of special binder. In general, preferable color forming ability is obtained when an internal phase oil containing a dye rapidly soaks into the color developer layer after the rupture of microcapsules. From this sense, the special binder used in this invention seems to make the soaking easier. Further, by the use of the special binder, the resistance to yellowing is also improved, but reasons for this are not clear. In this point, the special binder used in this invention can be distinguished from other known binders.

Another feature of this invention resides in the co-use of the semi-synthetic solid acid. The use of the semi-synthetic solid acid does not prevent directly the yellowing, but has improved color developing ability compared with other clay series color developers. Therefore, the using amount of novolak phenol resin which causes the yellowing can be reduced by the use of the semi-synthetic solid acid, which results in improving the resistance to yellowing indirectly.

This invention is illustrated by way of the following Examples, in which all parts and percents are by weight unless otherwise specified.

EXAMPLE 1

To 100 parts of an aqueous solution dissolving 0.5 part of sodium pyrophosphate, 100 parts of heavy calcium carbonate (Softon 2200, a trade name, mfd. by Bihoku Hunka Kogyo Co., Ltd.) was added gradually with stirring for sufficient dispersion. Then, 50 parts of a 40% dispersion of novolak para-phenylphenol resin (RBE 40, a trade name, mfd. by Mitsui Toatsu Chemicals, Inc.) was added thereto. Subsequently, 60 parts of a 20% aqueous solution of an acrylamide-acrylic acid (19.5:0.5 by weight) copolymer was added to resulting mixture as a binder with sufficient dispersing to give a coating liquid.

The coating liquid was coated on fine paper having a basis weight of 40 g/m$^2$ so as to make the coating amount 7 g/m$^2$ on dry basis with a blade coater to give a color developer sheet for pressure-sensitive recording.

EXAMPLE 2

The process of Example 1 was repeated except for using an acrylamide-acrlyic acid (90:10 by weight) copolymer as a binder to give a color developer sheet for pressure-sensitive recording.

EXAMPLE 3

The process of Example 1 was repeated except for co-using starch (MS #4600 mfd. by Nihon Shokuhin Kako Co., Ltd.) in a half amount (solid basis) of the acrylamide-acrylic acid copolymer to give a color developer sheet for pressure-sensitive recording.

EXAMPLE 4

To 100 parts of an aqueous solution dissolving 0.5 part of sodium pyrophosphate, 80 parts of heavy calcium carbonate (Soften 2200, a trade name, mfd. by Bihoku Hunka Kogyo Co., Ltd.) and 20 parts of semi-synthetic solid acid (Silton SS-1, a trade name, mfd. by Mizusawa Industrial Chemicals, Ltd.) were added gradually with stirring for sufficient dispersion. Then 20 parts of a 40% dispersion of novolak para-phenylphenol resin (RBE 40, a trade name, mfd. by Mitsui Toatsu Chemicals, Inc.) was added thereto. Subsequently, 60 parts of a 20% aqueous solution of an acrylamide-acrylic acid (99.5:0.5 by weight) copolymer was added to the resulting mixture as a binder with sufficient dispersing to give a coating liquid.

EXAMPLE 5

The process of Example 1 was repeated except for using 92 parts of heavy calcium carbonate as a pigment, 8 parts of the semi-synthetic solid acid, and 40 parts of a 40% novolak para-phenylphenol resin dispersion to give a color developer sheet for pressure-sensitive recording.

EXAMPLE 6

The process of Example 1 was repeated except for using 70 parts of heavy calcium carbonate, 30 parts of the semi-synthetic solid acid and 7.5 parts of a 40% novolak para-phenylphenol resin dispersion to give a color developer sheet for pressure-sensitive recording.

COMPARATIVE EXAMPLE 1

The process of Example 1 was repeated except for using styrene-butadiene rubber (SBR) latex (Dow Latex 636, a trade name, mfd. by Asahi Chemical Industry Co., Ltd.) as a binder in place of the acrylamide-acrylic acid copolymer to give a color developer sheet for pressure-sensitive recording. In order to obtained the same strength of the surface of the coating layer, 16 parts (in solid content) of SBR was necessary.

COMPARATIVE EXAMPLE 2

The process of Example 1 was repeated except for using oxidized starch (MS #3800, a trade name, mfd. by Nihon Shokuhin Kako Co., Ltd.) as a binder in place of the acrylamide-acrylic acid copolymer to give a color developer sheet for pressure-sensitive recording.

COMPARATIVE EXAMPLE 3

The process of Example 1 was repeated except for using polyvinyl alcohol (Gosenol NM-11, a trade name, mfd. by Nippon Synthetic Chemical Industry Co., Ltd.) as a binder in place of the acrylamide-acrylic acid copolymer to give a color developer sheet for pressure-sensitive recording. In order to obtain the same strength of the surface of the coating layer, 10 parts (in solid content) of the polyvinyl alcohol was necessary.

COMPARATIVE EXAMPLE 4

The process of Example 1 was repeated except for using a copolymer of acrylamide (80.5%)-acrylonitrile (12.0%)-acrylic acid (5.0%)-butyl acrylate (2.5%) (Polymer Set #600 mfd. by Arakawa Chemical Industries, Ltd.) as a binder in place of the acrylamide-acrylic acid copolymer to give a color developer sheet for pressure-sensitive recording.

COMPARATIVE EXAMPLE 5

The process of Example 1 was repeated except for using an acrylamide-acrylic acid (80:20 by weight) copolymer as a binder to give a color developer sheet for pressure-sensitive recording.

COMPARATIVE EXAMPLE 6

The process of Example 1 was repeated except for using an acrylamide-acrylic acid (50:50 by weight) copolymer as a binder to give a color developer sheet for pressure-sensitive recording.

COMPARATIVE EXAMPLE 7

The process of Example 4 was repeated except for using commercially available active clay (Silton M 140, a trade name, mfd. by Mizusawa Industrial Chemicals, Ltd.) obtained by acid treating in place of the semi-synthetic solid acid to give a color developer sheet for pressure-sensitive recording.

Each color developer sheet obtained in Examples 1 to 6 and Comparative Examples 1 to 7 was piled on a commercially available NCR sheet (mfd. by Mitsubishi Paper Mills, Ltd., blue) so as to face the coated layers oppositely and the assembled sheets were calendered under a pressure of 96 kg/cm.

The developed color density was obtained by the following equation measuring reflectances of colored portion and white ground portion (the smaller the value, the higher the density):

$$\text{Developed color density} = \frac{\text{Reflectance of colored portion}}{\text{Reflectance of white ground portion}} \times 1 \times 100$$

(The value of 1 hour after calendered.)

The yellowing of a color developer sheet by nitrogen oxides was measured according to JIS LO855-1976. That is, after allowing a color developer sheet to stand in a uniform atmosphere of nitrogen oxides in a concentration of 450 ppm generated according to JIS LO855-1976 for 30 minutes, reflectance was measured by a differential colorimeter with a blue filter (mfd. by nippon Denshoku Kogyo Co., Ltd.). The higher the value, the smaller the yellowing.

This test is an accelerated test for measuring yellowing of white ground portion of a color developer sheet when stored for a long period of time.

The results are shown in Table 1.

TABLE 1

| Example No. | Developed color density | Yellowing |
|---|---|---|
| Example 1 | 24 | 71 |
| Example 2 | 25 | 70 |
| Example 3 | 25 | 69 |
| Example 4 | 24 | 70 |
| Example 5 | 24 | 69 |
| Example 6 | 25 | 73 |
| Comparative Example 1 | 34 | 62 |
| Comparative Example 2 | 30 | 65 |
| Comparative Example 3 | 39 | 70 |
| Comparative Example 4 | 29 | 69 |
| Comparative Example 5 | 28 | 70 |
| Comparative Example 6 | 29 | 69 |
| Comparative Example 7 | 35 | 70 |

As mentioned above, the color developer sheet for pressure-sensitive recording of this invention is improved in the color forming ability and can prevent yellowing due to nitrogen oxides, which results in making it possible to maintain the whiteness of ordinary paper.

What is claimed is:

1. A color developer sheet for pressure-sensitive recording comprising a support and formed thereon a color developer layer comprising as a color developer a novolak phenol resin and as a binder a copolymer of acrylamide and acrylic acid in a monomer weight ratio of 90:10 to 99.5:0.5 in terms of the ratio of acrylamide to acrylic acid.

2. A color developer sheet according to claim 1, wherein the novolak phenol resin is at least one member selected from the group consisting of novolak para-phenylphenol resin, novolak para-t-butylphenol resin, novolak para-octylphenol resin, novolak para-chlorophenol resin, and novolak para-cumylphenol resin.

3. A color developer sheet according to claim 1, wherein the novolak phenol resin is novolak para-phenylphenol resin.

4. A color developer sheet for pressure-sensitive recording comprising a support and formed thereon a color developer layer comprising as a color developer a novolak phenol resin and a semi-synthetic solid acid, and as a binder a copolymer of acrylamide and acrylic acid in a monomer weight ratio of 90:10 to 99.5:0.5 in terms of the ratio of acrylamide to acrylic acid, said semi-synthetic solid acid obtained by acid treating a clay mineral having a layer structure of silica regular tetrahedron so as to make the $SiO_2$ content 82 to 96.5% by weight on dry basis (dried at 105° C. for 3 hours), contacting the acid-treated clay mineral with a partially soluble magnesium and/or aluminum-containing compound in an aqueous medium, or further neutralizing with an alkali or an acid to form a hydroxide when the partially soluble magnesium and/or aluminum-containing compound is other than a hydroxide, so as to introduce magnesium and/or aluminum components into the acid treated clay mineral, and if necessary followed by drying.

5. A color developer sheet according to claim 4, wherein the novolak phenol resin and the semi-synthetic solid acid are used in a weight ratio of 1:0.5 to 1:10.

6. A color developer sheet according to claim 4, wherein the novolak phenol resin is at least one member selected from the group consisting of novolak para-phenylphenol resin, novolak para-t-butylphenol resin, novolak para-octylphenol resin, novolak para-chlorophenol resin, and novolak para-cumylphenol resin.

7. A color developer sheet according to claim 4, wherein the novolak phenol resin is novolak para-phenylphenol resin.

* * * * *